US010675217B2

(12) United States Patent
Hesse

(10) Patent No.: US 10,675,217 B2
(45) Date of Patent: Jun. 9, 2020

(54) SPHERICAL PILL CONTAINER WITH DOMED LID

(71) Applicant: Corr-Jensen Inc., New York, NY (US)

(72) Inventor: Matthew Hesse, New York, NY (US)

(73) Assignee: Corr-Jensen Inc., Denver, CO (US)

( * ) Notice: Subject to any disclaimer, the term of this patent is extended or adjusted under 35 U.S.C. 154(b) by 0 days.

(21) Appl. No.: 15/917,273

(22) Filed: Mar. 9, 2018

(65) Prior Publication Data

US 2018/0256448 A1 Sep. 13, 2018

Related U.S. Application Data

(60) Provisional application No. 62/470,070, filed on Mar. 10, 2017.

(51) Int. Cl.

| | |
|---|---|
| ***A61J 1/03*** | (2006.01) |
| ***B65D 1/02*** | (2006.01) |
| ***B65D 43/16*** | (2006.01) |
| ***B65D 47/08*** | (2006.01) |
| *B65D 83/04* | (2006.01) |

(52) U.S. Cl.

CPC ..... *A61J 1/03* (2013.01); *B65D 1/0223* (2013.01); *B65D 43/164* (2013.01); *B65D 47/0838* (2013.01); *B65D 83/0481* (2013.01)

(58) Field of Classification Search

CPC ..... B65D 1/0223; B65D 43/164; B65D 47/0838; B65D 83/0481; A61J 1/03

USPC ..... 206/540; 220/4.22, 4.24, 4.25

See application file for complete search history.

(56) References Cited

U.S. PATENT DOCUMENTS

| | | | | |
|---|---|---|---|---|
| 1,715,757 A * | 6/1929 | Hirtzler | ..... | B65D 81/00 206/822 |
| 1,863,001 A | 6/1932 | Barok et al. | | |
| 3,494,515 A * | 2/1970 | Fattori | ..... | B65D 11/02 222/548 |
| 4,165,709 A | 8/1979 | Studer | | |
| D255,988 S | 7/1980 | Mascia | | |

(Continued)

FOREIGN PATENT DOCUMENTS

| | | |
|---|---|---|
| FR | 1315861 | 1/1963 |
| FR | 2659066 | 9/1991 |
| WO | WO 05/023660 | 3/2005 |

OTHER PUBLICATIONS

"Gum sphere provides a design to chew on," Packaging Digest, Jun. 30, 2007.

(Continued)

*Primary Examiner* — King M Chu

(74) *Attorney, Agent, or Firm* — Brownstein Hyatt Farber Schreck, LLP

(57) ABSTRACT

Embodiments are directed to a spherically shaped bottle. The spherically shaped bottle may be configured to hold and dispense ingestible pills, including tablets, capsules, or other ingestible products. The spherically shaped bottle may include a container body that holds the ingestible pills within an internal volume. A cap may be pivotally coupled with the container body and configured to cover the internal volume. The cap may define a spherical outer surface of the container with the container body when closed. The spherically shaped bottle may include a neck above the internal volume configured to dispense ingestible pills when the spherically shaped bottle is tilted.

18 Claims, 12 Drawing Sheets

(56) References Cited

U.S. PATENT DOCUMENTS

| | | | | |
|---|---|---|---|---|
| 4,262,802 | A | 4/1981 | Laauwe | |
| 4,475,654 | A | 10/1984 | Fruchter | |
| 5,231,938 | A | 8/1993 | Gore | |
| D339,986 | S | 10/1993 | Garouste | |
| 5,988,424 | A * | 11/1999 | Kovens | B65D 43/169 206/540 |
| 6,050,438 | A | 4/2000 | Kovens et al. | |
| 6,089,402 | A | 7/2000 | Pracas | |
| 6,102,209 | A | 8/2000 | D'Andrea | |
| D446,122 | S | 8/2001 | Weinstein | |
| D455,189 | S | 4/2002 | Bradbury | |
| D456,245 | S | 4/2002 | Ferris | |
| D465,733 | S | 11/2002 | Hill | |
| D475,288 | S | 6/2003 | Hoffmann | |
| D478,813 | S | 8/2003 | Beene | |
| D495,250 | S | 8/2004 | Learey | |
| D552,473 | S | 10/2007 | Simkin | |
| D561,030 | S | 2/2008 | Simkin | |
| D564,900 | S | 3/2008 | Green | |
| D570,687 | S | 6/2008 | Kelders | |
| D572,535 | S | 7/2008 | El-Ghouyel | |
| D578,002 | S | 10/2008 | Canamasas Puigbo | |
| D585,293 | S | 1/2009 | Honkawa | |
| D592,064 | S | 5/2009 | Kilany | |
| D612,245 | S | 3/2010 | Canamasas | |
| D639,449 | S | 6/2011 | Luburic | |
| D650,280 | S | 12/2011 | de Peyerimhoff et al. | |
| D667,240 | S | 9/2012 | Weldon | |
| 8,322,112 | B2 | 12/2012 | Luburic | |
| D691,881 | S | 10/2013 | Ivey | |
| D696,555 | S * | 12/2013 | Kolano | D7/590 |
| D726,550 | S | 4/2015 | Lu | |
| D735,414 | S | 7/2015 | Schlatter | |
| D749,368 | S | 2/2016 | Risso | |
| D758,867 | S | 6/2016 | Tsai | |
| D771,495 | S | 11/2016 | Buogo | |
| D779,329 | S | 2/2017 | Buogo | |
| D787,338 | S | 5/2017 | Dorsinville | |
| D791,608 | S | 7/2017 | Dorsinville | |
| D797,553 | S | 9/2017 | Huang | |
| D804,099 | S | 11/2017 | Teller | |
| D811,901 | S | 3/2018 | Dardashty | |
| D819,748 | S | 6/2018 | Luk | |
| D821,885 | S | 7/2018 | Paulin | |
| 2003/0201201 | A1 * | 10/2003 | Cheng | B65D 81/36 206/457 |
| 2006/0254945 | A1 * | 11/2006 | Green | A45D 40/0068 206/457 |
| 2007/0272711 | A1 * | 11/2007 | MacLeod | B65D 1/0215 222/215 |
| 2009/0307924 | A1 | 12/2009 | Aouad et al. | |
| 2011/0253729 | A1 * | 10/2011 | Ring | B65D 1/0223 220/681 |
| 2015/0053801 | A1 | 2/2015 | Smit | |

OTHER PUBLICATIONS

AliExpress.com, 200pcs/lot 9g empty medicine pill jar Spherical Round jar medicine globule box Plastic medicine butter pill Container.

International Search Report and Written Opinion dated May 16, 2018, PCT/US2018/021829, 12 pages.

* cited by examiner

SPHERICAL PILL CONTAINER WITH DOMED LID

CROSS-REFERENCE TO RELATED APPLICATION

This application is a non-provisional patent application of and claims the benefit to U.S. Provisional Patent Application No. 62/470,070, filed Mar. 10, 2017, and titled "Spherical Pill Container with Domed Lid," the disclosure of which is hereby incorporated herein by reference in its entirety.

FIELD

The described embodiments relate generally to containers. More particularly, the present embodiments relate to containers for storing and dispensing ingestible pills, such as tablets, capsules, or other ingestible products.

BACKGROUND

A pill bottle or container may be used to hold pills or other ingestible health-related product. Traditionally, pill containers are formed from cylindrical or rectangular shaped bodies, which may limit the ability to visually differentiate the container from other products. In some cases, larger pills or capsules may not fit well within a cylindrical or rectangular bottle and may become jammed or bind. Additionally, traditional pill containers typically contain screw-top lids which may be difficult to open or may be separated and lost from the container. The devices and assemblies described herein are directed to container designs that do not have some of the drawbacks associated with some traditional pill bottles.

SUMMARY

Embodiments of the present invention are directed to a spherical container or pill bottle.

In a first aspect, the present disclosure includes a spherical bottle. The spherical bottle includes a container body having an internal volume for holding ingestible pills. The container body includes a shoulder defining an upper surface of the container body. The container body further includes a neck extending from the shoulder and defining an opening into the internal volume. The spherical bottle includes a collar connected to the container body and positioned around the neck. The spherical bottle further includes a domed lid pivotally coupled to the collar and configured to cover the opening of the neck when closed and expose the opening of the neck when open. The container body, collar, and domed lid cooperate to form a substantially spherical outer surface of the bottle.

A number of feature refinements and additional features are applicable in the first aspect and contemplated in light of the present disclosure. These feature refinements and additional features may be used individually or in any combination. As such, each of the following features that will be discussed may be, but are not required to be, used with any other feature combination of the first aspect.

For example, in an embodiment, the collar may include a notch that defines a first hinge member. The domed lid may include a protrusion that defines second hinge member that is positioned within the notch of the first hinge member. The first hinge member and the second hinge member may cooperate to pivotally couple the domed lid and the collar.

When the domed lid is closed, the first hinge member and the second hinged member may cooperate to define a partially spherical surface.

In another embodiment, the container body may define a concave bottom surface. An edge of the concave bottom surface may support the spherical bottle when the spherical bottle is placed in an upright position. The opening may have a width that is less than half of a width of a middle portion of the container. In some cases, the width of the middle portion is between one and five inches. The domed lid may be pivotally coupled to the container body at the shoulder.

In a second aspect, the present disclosure includes a spherical bottle. The spherical bottle includes a container body defining an internal volume configured to hold a group of pills, a neck having an opening extending into the internal volume, and a first partially spherical surface of the spherical bottle. The spherical bottle further includes a collar attached to the container body, surrounding the neck, and defining a second partially spherical surface of the spherical bottle. The spherical bottle includes a domed lid pivotally coupled to the collar configured to seal the internal volume at the neck, and defining a third partially spherical surface of the spherical bottle. The first partially spherical surface, the second partially spherical surface, and the third partially spherical surface define a substantially spherical outer surface of the spherical pill bottle.

A number of feature refinements and additional features are applicable in the second aspect and contemplated in light of the present disclosure. These feature refinements and additional features may be used individually or in any combination. As such, each of the following features that will be discussed may be, but are not required to be, used with any other feature combination of the second aspect.

For example, in an embodiment, the domed lid may include a lip that extends from a bottom surface. The lip may be configured to engage the neck when the domed lid is closed. The lip may maintain contact with a surface of the neck when the domed lid is closed.

In another embodiment, the neck includes a threaded feature. As such, the container body and the collar may be attached by the threaded feature. Additionally or alternatively, the neck includes a snap-fit feature. As such, the container body and the collar may be attached by the threaded feature.

In another embodiment, the opening may have a width configured to channel the group of pills from the internal volume when the spherical pill bottle is tilted. The spherically shaped container body has a bottom region having a width configured to prevent tipping of the spherical pill bottle in an upright position. Additionally or alternatively, the collar may include a notched portion below the domed lid. The notched portion may form an undercut with the domed lid. In some cases, the undercut may be configured to receive a force that pivots the domed lid relative to the collar.

In a third aspect, the present disclosure includes a spherical bottle. The spherical bottle includes a container body defining an internal volume and a first partially spherical outer surface extending from a bottom portion of the spherical bottle to beyond a centerline of the spherical bottle. The spherical bottle further includes a domed lid extending over an opening of the container body and defining a second partially spherical outer surface. The domed lid is configured to pivot relative to the container body to contain ingestible pills within the internal volume when the domed lid is in a closed configuration. The first partially spherical outer surface cooperates with the second partially spherical outer surface to define a substantially spherical outer surface of the spherical bottle.

A number of feature refinements and additional features are applicable in the third aspect and contemplated in light of the present disclosure. These feature refinements and additional features may be used individually or in any combination. As such, each of the following features that will be discussed may be, but are not required to be, used with any other feature combination of the third aspect.

For example, in an embodiment, the domed lid may be positioned concentric with a central axis of the container body. The first substantially spherical outer surface of the container body may be a substantially seamless surface.

In another embodiment, the container body may include a neck that defines the opening. The domed lid may engage the neck when the domed lid is in a closed configuration. The container body may include a wall that at least partially defines the internal volume. The wall may have a substantially uniform thickness.

In addition to the exemplary aspects and embodiments described above, further aspects and embodiments will become apparent by reference to the drawings and by study of the following description.

BRIEF DESCRIPTION OF THE DRAWINGS

The disclosure will be readily understood by the following detailed description in conjunction with the accompanying drawings, wherein like reference numerals designate like elements.

Figure 1A:
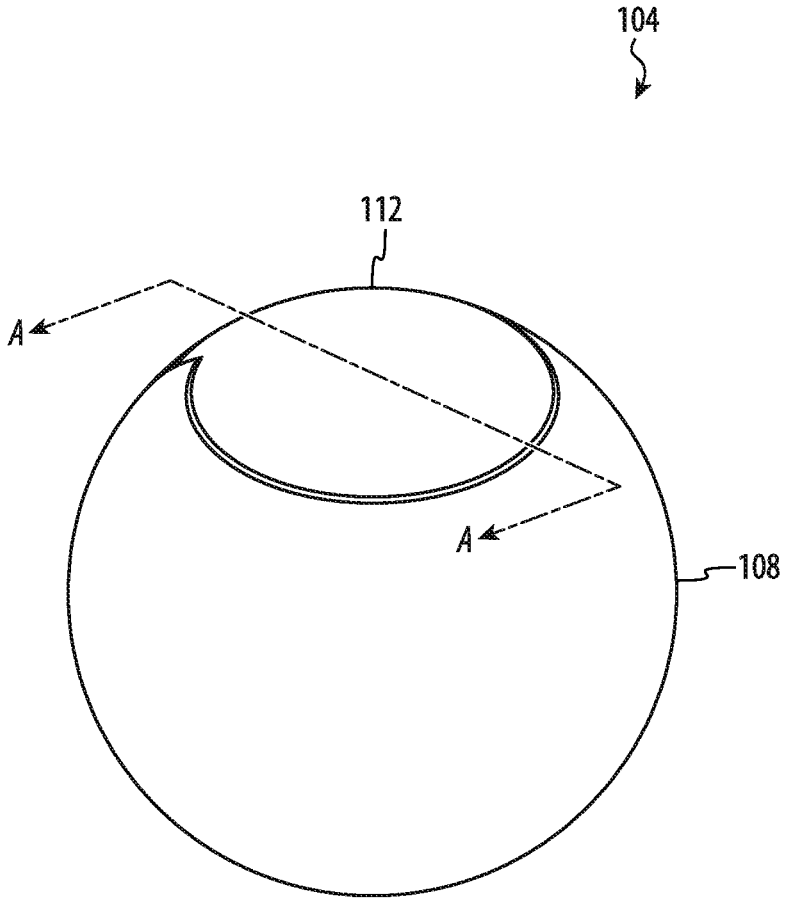
FIG. 1A depicts an example spherical bottle in a closed configuration.

The use of cross-hatching or shading in the accompanying figures is generally provided to clarify the boundaries between adjacent elements and also to facilitate legibility of the figures. Accordingly, neither the presence nor the absence of cross-hatching or shading conveys or indicates any preference or requirement for particular materials, material properties, element proportions, element dimensions, commonalities of similarly illustrated elements, or any other characteristic, attribute, or property for any element illustrated in the accompanying figures.

Additionally, it should be understood that the proportions and dimensions (either relative or absolute) of the various features and elements (and collections and groupings thereof) and the boundaries, separations, and positional relationships presented therebetween, are provided in the accompanying figures merely to facilitate an understanding of the various embodiments described herein and, accordingly, may not necessarily be presented or illustrated to scale, and are not intended to indicate any preference or requirement for an illustrated embodiment to the exclusion of embodiments described with reference thereto.

DETAILED DESCRIPTION

The description that follows includes sample systems, methods, and apparatuses that embody various elements of the present disclosure. However, it should be understood that the described invention may be practiced in a variety of forms in addition to those described herein.

The present disclosure describes systems, devices, and techniques related to a spherically shaped bottle. The spherically shaped bottle may include an internal volume or cavity that is configured to receive, contain, or otherwise hold ingestible pills. For purposes of the following description, the term pill may be used to refer to tablets, capsules, or other ingestible products, whether health-related or otherwise adapted for human consumption. In many cases, the pills are used to deliver a nutritional supplement, medicine, or other therapeutic substance. The pills may typically be consumed or ingested according to a medically prescribed regimen or they may be consumed at will by the user, depending on type of pill that is being ingested. A pill may have a size and shape that is able to be consumed by swallowing the pill whole. However, in some cases, the pill may be chewable or ingested in portions.

The pills are held or contained within an internal volume or cavity defined by the spherically shaped bottle. The spherically shaped bottle may have a curved, convex, or bulbous outer surface that approximates a sphere or partially spherical shape. The spherical outer surface of the bottle may be defined by a group of components that together form a substantially continuous spherical shape of the bottle. For purposes of the following examples, a substantially continuous spherical shape may be used to refer to a shape that is generally spherical but may include one or more facets, concave portions, or other non-spherical features to geometry. For example, as provided in the following examples, a substantially spherically shaped bottle may have a flat or concave bottom portion that supports the bottle in an upright position when placed on a flat surface like a tabletop. At least a portion of the spherical shape may be defined by a substantially seamless surface, such as a surface that extends from a bottom portion of the bottle to a top portion that is beyond a middle portion of the bottle. In one example described in more detail below, the bottle may include a container body, a collar, and a domed lid that cooperate to form a substantially continuous spherical outer surface of the bottle.

The container body may be a substantially hollow member that defines the internal volume or cavity of the spherically shaped bottle. The internal volume may be sized to hold or receive ingestible pills or other materials. The shape of the internal volume may be substantially free of sharp corners or narrow interior angles, which may help preserve the pills and reduce the chance of damage. In some cases, the internal volume is free of angle that are 90 degrees or less.

The container body, or other features of the spherically shaped bottle, may be used to predictably dispense the pills from the internal volume. For example, the container body may have a neck extending from the internal volume and defining an opening. The neck may be used to dispense pills from the container and may define an opening that is sized to allow one or two pills to be dispensed into the hand of a user as the bottle is tipped. In some cases, the opening of the neck allows no more than 5-7 pills to be dispensed at a time when the bottle is tipped. In some cases, the neck may also be used to fill the internal volume with pills, for example, by a filling machine, a user, and so on.

The domed lid may define a top spherical surface of the container that pivots relative to the collar and/or the container body to selectively enclose or cover the ingestible pills within the interior volume. The domed lid may define a second hinge feature that extends along a convex surface of the domed lid. The second hinge feature may be pivotally connected with the first hinge feature. For example, the second hinge feature may be a protrusion that is received by the first hinge member. This may allow the domed lid to move relative to the collar and/or the container body across a continuum of positions.

The domed lid may include various structures, components, or geometries that facilitate selectively enclosing the domed lid over the interior volume of the container body. For example, a lip or other protrusion may extend from a bottom surface of the domed lid and partially into the interior volume of the bottle when the domed lid is in a closed position. The lip may interface or engage the container body and/or the collar, which may maintain the domed lid in the closed position.

In some examples, a collar may be positioned around the neck and cooperate with the dome and the container body to form a substantially continuous partially spherically shaped outer surface. In some cases, the collar may surround or encircle the container body at the neck. A portion of the collar may define a first hinge feature, such as a receiving recess, that allows the collar to pivotally couple with the domed lid or other articulating member.

The domed lid and the collar and/or the container body may cooperate to define a finger tab or finger notch of the spherically shaped bottle. For example, the collar and/or the container body may include a notched portion that facilitates opening the hemispherical lid. The notched portion may be positioned along an interface with the domed lid in order to form an undercut region below the domed lid. The undercut region may allow a user to grip and move the domed lid to access the interior volume of the spherical bottle and any ingestible pills contained therein.

Reference will now be made to the accompanying drawings, which assist in illustrating various features of the present disclosure. The following description is presented for purposes of illustration and description. Furthermore, the description is not intended to limit the inventive aspects to the forms disclosed herein. Consequently, variations and modifications commensurate with the following teachings, and skill and knowledge of the relevant art, are within the scope of the present inventive aspects.

FIG. 1A depicts an example spherical bottle 104. The spherical bottle 104 may have a substantially spherical shape or otherwise resemble the shape of a sphere. For purposes of the following description, a partially spherical or substantially spherical shape may be used to refer to geometry that is spherical or nearly spherical over a substantial portion of the outer surface. However, it is not necessary that the geometry be perfectly spherical or entirely spherical and may include various flattened, concave, or other geometrically shaped regions along the outer surface, such as at a bottom surface to prevent tipping of the spherical bottle 104.

The spherical bottle 104 may be used to hold or retain a volume or number of ingestible pills. As previously mentioned, the ingestible pills may include tablets, capsules, or other similarly shaped products having a particular dosage of a medicinal product, supplement, or other ingestible ingredient. The spherical bottle 104 may be configured to selectively open and close to allow a user to store and/or retrieve ingestible pills. The spherical bottle 104 may be configured to be held in a user's hand and readily tilted to dispense the pills contained within.

In the embodiment of FIG. 1A, the spherical bottle 104 includes a container body 108 and a domed lid 112. The container body 108 and the domed lid 112 may cooperate to define a substantially spherical surface of the spherical bottle 104. The container body 108 and the domed lid 112 may be pivotally coupled to one another. In the current example, the domed lid 112 is configured to pivot relative to the container body 108 to contain ingestible pills within the internal volume when the domed lid 112 is in a closed configuration. The domed lid 112 may also be pivoted into an open configuration exposing an opening into the container body 108 and allowing the pills to be dispensed or the spherical bottle 104 to be filled.

The container body 108 may be a convex, bulbous, or other substantially spherical structure. The container body 108 may be a substantially seamless structure or otherwise have a seamless surface that extends from a bottom region of the spherical bottle 104 to a top portion that is beyond a middle portion or midpoint (centerline) of the spherical bottle; however, this is not required. The domed lid 112 may be a semi-spherical cap or spherical segment that defines a partially spherical surface of the spherical bottle 104. In the current example, the domed lid 112 is positioned concentric with an uppermost portion of the spherical bottle 104. In a closed position or configuration, as shown in FIG. 1A, the partially spherical surface of the domed lid 112 is substantially continuous with the partially spherical surface of the container body 108.

Figure 1B:
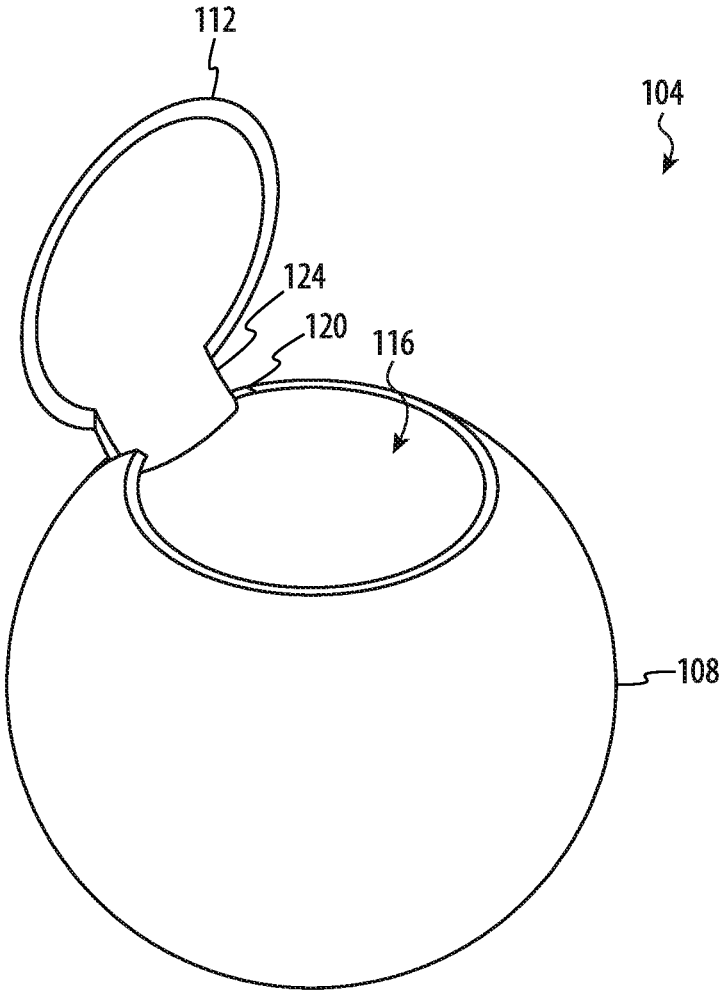
FIG. 1B depicts the example spherical bottle of FIG. 1A in an open configuration.

FIG. 1B depicts the spherical bottle 104 of FIG. 1A in an open configuration. In particular, FIG. 1B depicts the spherical bottle 104 having the domed lid 112 in an open configuration. When the domed lid 112 is in an open configuration, the domed lid 112 may be moved or pivoted relative to the container body 108 to expose an opening in the container body 108. In the current example, the opening in the container body 108 extends into the internal volume 116, which is defined by a cavity or hollow portion of the container body 108. The internal volume 116 may be configured to hold or contain the ingestible pills. For example, the internal volume 116 may be defined by an appropriate size and shape that allows a quantity of ingestible pills to be arranged within the internal volume 116, as explained in greater detail below with respect to FIG. 2.

The domed lid 112 may pivot or otherwise move relative to the container body 108 between an open configuration and a closed configuration. This may allow a user to manipulate the domed lid 112 to selectively enclose ingestible pills within the internal volume 116. To facilitate the foregoing, the domed lid 112 and the container body 108 may each include a hinge feature or other component that allows the domed lid 112 and the container body 108 to pivotally couple to one another.

As shown in FIG. 1B, the container body 108 may include a first hinge member 120 and the domed lid 112 may include a second hinge member 124. The first hinge member 120 may define a notch or other receiving portion formed into a surface of the container body 108. The second hinge member 124 may include a protrusion or tongue that extends from a surface of the domed lid 112. The second hinge member 124 may be received by the first hinge member 120. The first hinge member 120 and the second hinge member 124 may cooperate to define a partially spherical surface when the domed lid 112 is in a closed position. A pin, shaft, or other support structure (not shown in FIG. 1B) may extend through the first and the second hinge members 120, 124 to structurally support the domed lid 112 above the container body 108 as the domed lid 112 pivots relative to the container body 108.

It will be appreciated that the first and second hinge members 120, 124 are presented in FIG. 1B for purposes of illustration only. Other hinge members and coupling structures are contemplated within the scope of the present invention that may allow the domed lid 112 to pivot relative to the container body 108. For example, in an embodiment, the container body 108 and the domed lid 112 may be an integrally formed component. A thinned region between the container body 108 and the domed lid 112 may define a living hinge that allows the domed lid 112 to pivot relative to the container body 108. In other embodiments, other hinge members and coupling structures are completed, for example, such as those described in greater detail below with respect to FIGS. 3A-5.

Figure 2:
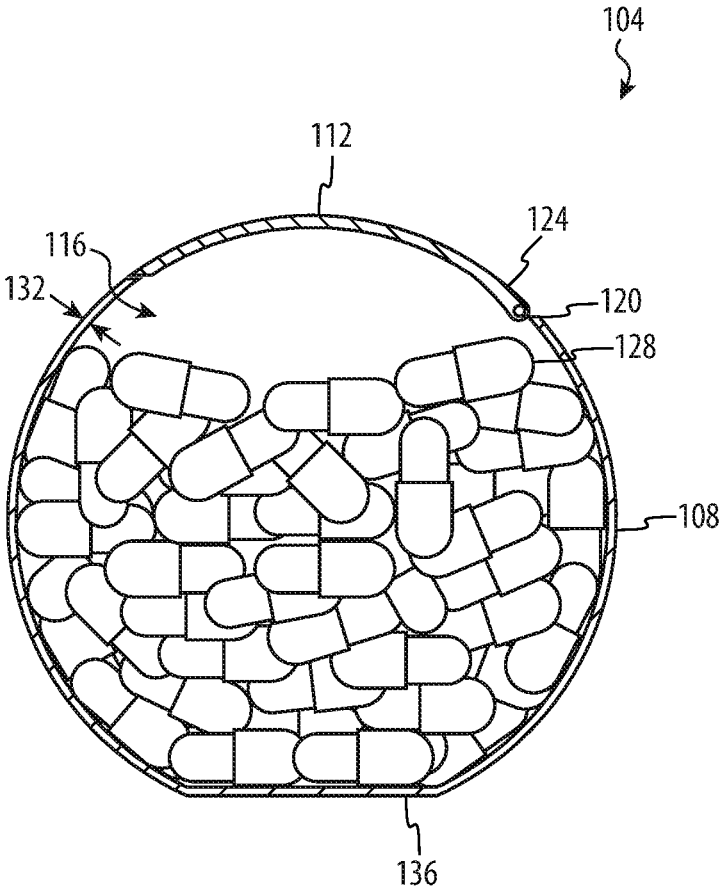
FIG. 2 depicts a cross-sectional view of the embodiment of the spherical bottle of FIG. 1A containing a group of pills, taken along line A-A of FIG. 1A.

FIG. 2 depicts a cross-sectional view of the spherical bottle of FIG. 1A, taken along line A-A of FIG. 1A. In the embodiment of FIG. 2, the spherical bottle 104 is shown containing ingestible pills 128. The ingestible pills 128 may be pills, tablets, capsules, or another type of ingestible product or material. As shown in the example, of FIG. 2, the ingestible pills 128 may be substantially uniform and have a size and a shape that allows multiple groups or sets of ingestible pills 128 to be contained within the internal volume 116. As shown in FIG. 2, the internal volume 116 may be substantially free of sharp corners or narrow interior angles. In the example of FIG. 2, the internal volume 116 is free of acute or narrow angles that are less than 90 degrees. This may reduce the damage to the pills 128 during transport or handling and may also maximize the volume that can be contained in a hand-held product.

The domed lid 112 is shown in the closed position in FIG. 2. As such, the domed lid 112 may form a cover or enclosure over the ingestible pills 128 within the internal volume 116. As described above, the domed lid 112 and the container body 108 may be pivotally coupled to one another (e.g., via the first and second hinge members 120, 124). This may allow a user to move or manipulate the domed lid 112 relative to the container body 108 to selectively enclose or cover the ingestible pills 128 within the internal volume 116. For example, a user may pivot the domed lid 112 relative to the container body 108 to an open position or configuration allowing the user to access the ingestible pills 128.

The container body 108 may be a substantially unitary component formed from a single continuous element. For example, the container body 108 may be constructed from a moldable plastic, ceramic, or other material that is formed from using a molding process that allow for the formation of a single piece or element that defines an internal cavity. In some case, the container body 108 is formed using a blow-molding or other similar molding process. In some cases, the container body 108 may be formed from a single element or sheet of metal material, which may be machined or stamped to produce the substantially spherical or convex shape of the container body 108. However, it will be appreciated that the container body 108 need not be a unitary component. In other embodiments, multiple discrete components (e.g., sidewalls, a base, and so on) may be connected, bonded, fused, or otherwise coupled together to form the container body 108.

The container body 108 may have a wall 132 having an inner surface that at least partially defines a size and a shape of the internal volume 116. For example, the container body 108 may be constructed having a wall 132 that varies in thickness based on a desired shape and size of the internal volume 116. In some cases, as shown in FIG. 2, the wall 132 may have a substantially uniform thickness.

The container body 108 may also define a base 136. The base 136 may be a substantially flat or planar portion of the exterior surface of the container body 108. The base 136 may be appropriately sized and shaped to stabilize or balance the container body 108 in an upright or semi-upright position. This may allow the container body 108 to maintain an upright position when the internal volume 116 contains the ingestible pills 128. The base 136 may also help support or maintain the upright position when the domed lid 112 is in the open and/or closed position, as described above. It will be appreciated that the base 136 may have any appropriate width to facilitate the foregoing stabilization of the container body 108. For example, the base 136 may have a width that is equal to or less than a width of the container body 108 at, for example, a centerline of the container body 108. In some cases, the width of the base 136 may be defined as a percentage of the width of the container body 108 at the centerline, such as the base 136 have a width that is 90%, 80%, 70%, 60%, 50%, and so forth, of a width of the container body 108 at the centerline. The centerline may be a middle or middle portion of the container body 108 having a width of between one and five inches. In other cases, the width of the container body 108 at the centerline may be less than one inch or greater than 5 inches.

FIGS. 3A-5B depict a sample spherical bottle according to another embodiment. As illustrated, FIGS. 3A-5B depict a spherical bottle 204. The spherical bottle 204 may be substantially analogous to the spherical bottle 104 described above with respect to FIGS. 1A-2. For example, the spherical bottle 204 may be a substantially spherical shaped bottle configured to contain ingestible pills. Further, the spherical bottle 204 may have a lid that is configured to pivot between a closed and open configuration to allow a user to store and/or retrieve ingestible pills. In this regard, analogous to the components described with respect to the embodiments of FIGS. 1A-2, the spherical bottle 204 may include: a container body 208, a domed lid 212, an internal volume 216, a first hinge member 220, a second hinge member 224, ingestible pills 228, wall thickness 232, and a base 236.

Figure 3A:
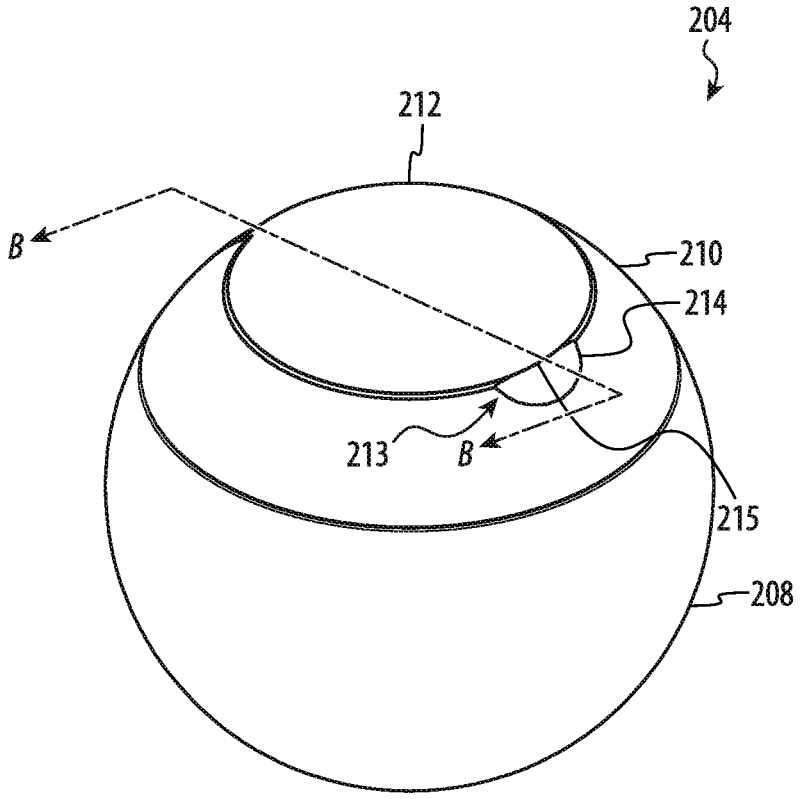
FIG. 3A depicts another example of a spherical bottle in a closed configuration.

Notwithstanding the foregoing similarities, the spherical bottle 204 may include a collar 210. The collar 210 may be used to define an outer partially spherical surface of the spherical bottle 204. For example, in a closed position or configuration, as shown in FIG. 3A, the container body 208, the collar 210, and the domed lid 212 may cooperate to form the outer spherical surface of the spherical bottle 204. In particular, the body 208 may define a first partially spherical or convex outer surface, the collar 210 may define a second partially spherical or convex outer surface, and the domed lid 212 may define a third partially spherical or convex outer surface. Together, the partially spherical outer surfaces of the body 208, the collar 210, and the domed lid 212 cooperate to define a substantially spherical outer surface of the spherical bottle 204.

The domed lid 212 may be a pivoting or articulating member that allows a user to open and close the spherical bottle 204. In the embodiment of FIGS. 3A-5B, the domed lid 212 may be pivotally coupled with the collar 210. Accordingly, a user may open or close the spherical bottle 204 by moving the domed lid 212 relative to the collar 210. The collar 210 may be coupled or affixed to the container body 208. As such, movement of the domed lid 212 relative to the collar 210 may move the domed lid 212 relative to the container body 208 as well. This may allow the domed lid 212 to cover or enclose the internal volume 216 of the container body 208.

To facilitate opening and closing the domed lid 212, the spherical bottle 204 may include a finger notch 213. The finger notch 213 may be used to provide a gripping surface or other feature that allows a user to manipulate the domed lid 212. In the embodiment of FIG. 3A, the collar 210 and the domed lid 212 may cooperate to define the finger notch 213. For example, the collar 210 may include a notched portion 214. The notched portion 214 may be a substantially planar surface, concave surface, or otherwise recessed portion of the collar 210. The notched portion 214 may at least partially define an overhang region 215. The overhang region 215 may be a portion of the domed lid 212 that extends over the notched portion 214. A user may grip or engage the domed lid 112 at the overhang region 215 to manipulate the domed lid 212 into any of a continuum of positions relative to the collar 210 and/or the container body 208. In the embodiment of FIG. 3A, the overhang region 215 has a contour that aligns with or matches the substantially spherical contour of spherical bottle 204. In other cases, the overhang region 215 may be a protrusion, catch, bill or other feature that partially extends beyond the substantially spherical contour of the spherical bottle 204.

Figure 3B:
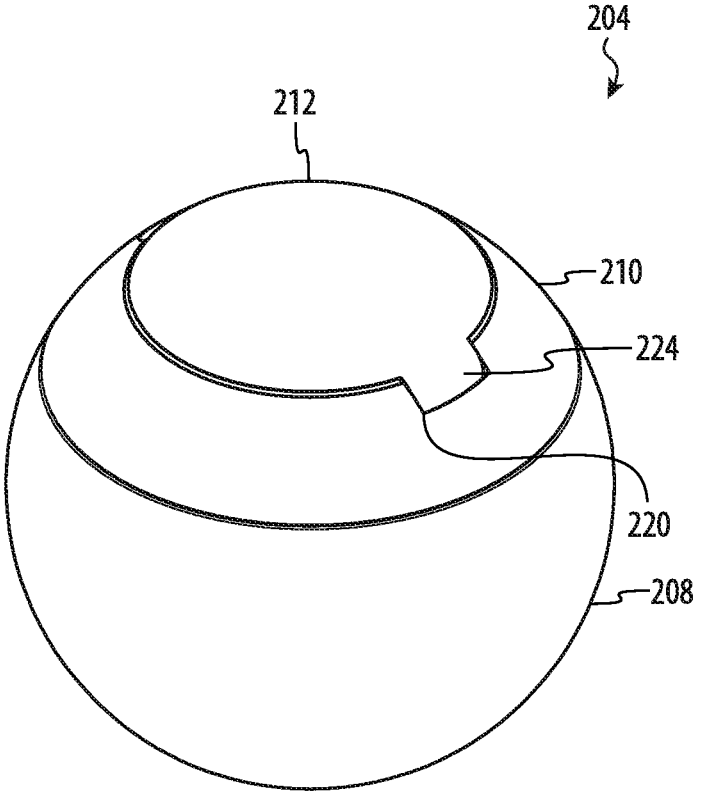
FIG. 3B depicts a rear view of the spherical bottle of FIG. 3A.

FIG. 3B depicts a rear view of the spherical bottle 204 described with respect to FIG. 3A. As shown in FIG. 3B, the spherical bottle is in a closed position or configuration. In the closed position, the first hinge member 220 of the collar 210 and the second hinge member 224 of the domed lid 212 cooperate to form a portion of a continuous spherical surface of the spherical bottle. For example, the second hinge member 224 may have a contoured surface configured to match the spherical contour of the spherical bottle 204. The spherical contour of the spherical bottle 204 may be exhibited by the first hinge member 220 of the collar 210. This may be the case where the first hinge member 220 includes a groove or other feature defined into an exterior surface of the collar 210 (such as an exterior surface that is a spherical section of the spherical bottle 204). Accordingly, when the domed lid 212 is pivoted into the closed position shown with respect to FIG. 3B, the contoured surface of the first second member 224 may be aligned with the spherical contour of the spherical bottle 204. This allows the first hinge member 220 and the second hinge member 224 to pivot relative to one another without interrupting the spherical outer surface of the spherical bottle 204 when the spherical bottle 204 is in the closed configuration.

Figure 3C:
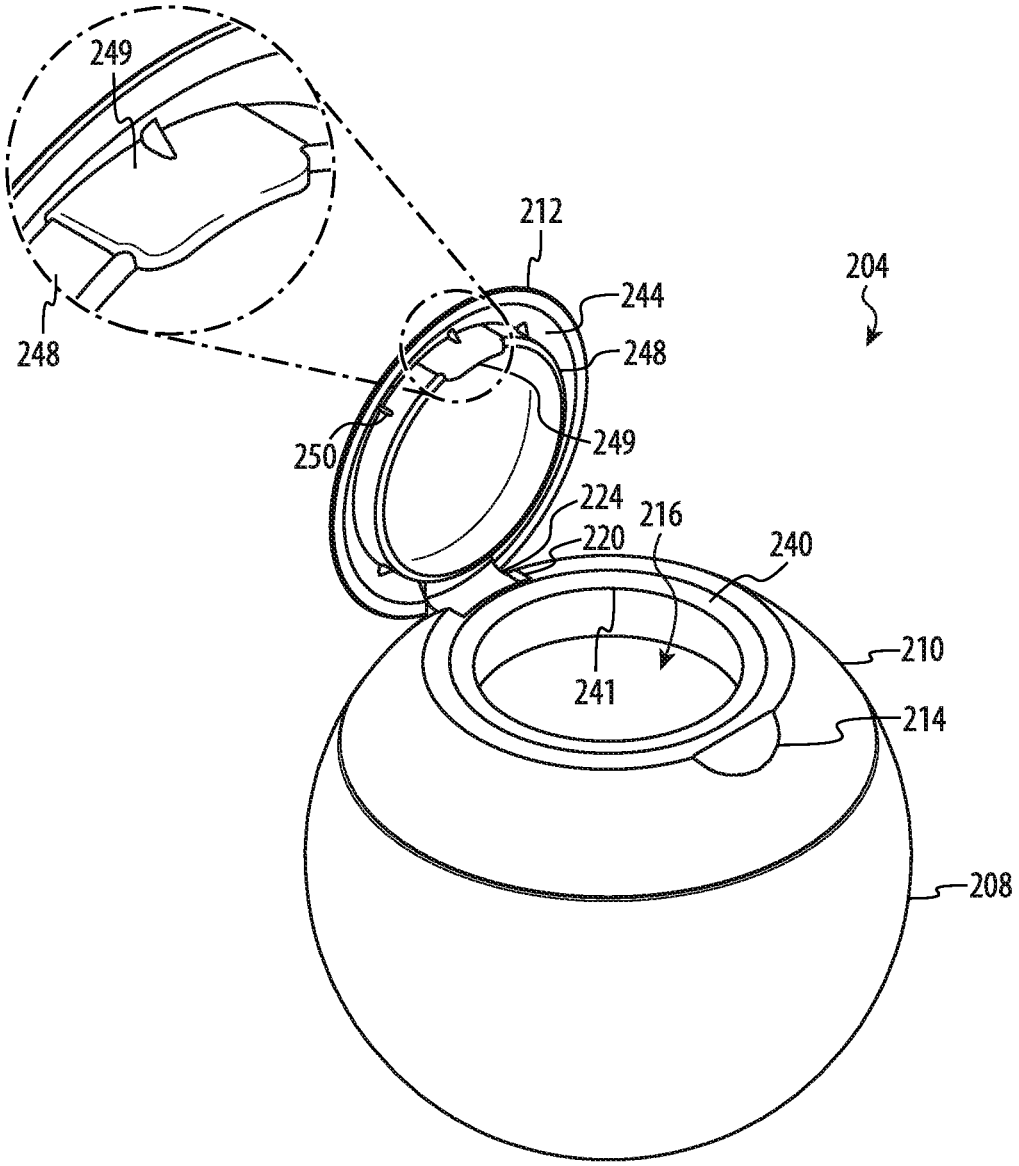
FIG. 3C depicts the example spherical bottle of FIG. 3A in an open configuration.

FIG. 3C depicts the spherical bottle 204 of FIG. 3A in an open configuration. In particular, FIG. 2C depicts the spherical bottle 204 in a configuration in which the domed lid 212 is moved or pivoted relative to the collar 210 and the container body 208 to reveal the internal volume 216. As described above with respect to FIGS. 1A-2, the internal volume 216 may be configured to hold or contain ingestible pills 228 (not shown in FIG. 3B).

As shown in FIG. 3C, the spherical bottle 204 may include the first and second hinge members 220, 224. In the embodiment of FIG. 3B, the collar 210 may include the first hinge member 220 and the domed lid 212 may include the second hinge member 224. The first hinge member 220 may define a notch or other receiving portion formed into the collar 210. The second hinge member 224 may include a protrusion or tongue that extends from a surface of the domed lid 212. Substantially analogous to the first and second hinge members 120, 124 described above with respect to FIGS. 1A-2, a pin, shaft, or other support structure (not shown in FIG. 1B) may extend through the first and second hinge members 220, 224 to structurally support the domed lid 212 above the container body 208 as the domed lid 212 pivots relative to the container body 208.

In the embodiment of FIGS. 3A-5B, the container body 208 may have a neck 240 that defines an opening 241 extending into the internal volume 216. The neck 240 may be configured to selectively dispense ingestible pills from the internal volume 216, such as being sized to allow one or two pills from the internal volume 216 into the hand of a user as the container body 208 is tipped or otherwise manipulated. As shown in FIG. 3C, the neck 240 may extend upward through the collar 210 and toward the domed lid 212. The opening 241 defined by the neck 240 may be a passage or through portion that provides access to the ingestible pills held within the internal volume 216. In this regard, the domed lid 212 may enclose or cover the ingestible pills by pivoting relative to the collar 210 to enclose or cover the opening 241 defined by the neck 240.

With reference to FIG. 3C, the collar 210 may be positioned around the neck 240 of the container body 208. For example, the collar 210 may be a ring, hoop, or other circular feature that surrounds or encircles the neck 240. The collar 210 may have a convex or substantially curved outer surface that defines a portion of the spherical outer surface of the spherical bottle 204 around the neck 240. In some cases, the neck 240 may extend beyond a top surface of the collar 210. This may allow the neck 240 to engage the domed lid 212 to cover or enclose the internal volume 216.

The domed lid 212 may have an underside surface 244. The underside surface 244 may be a substantially concave surface that extends over the opening 241. The domed lid 212 may include one or more features that extend from, or are coupled with, the underside surface 244 to facilitate enclosing or covering the internal volume 216 with the domed lid 212. In the embodiment of FIG. 3C, the domed lid 212 includes a ring 248 extending from the underside surface 244. The ring 248 may include a tongue 249 that protrudes beyond a surface of the ring 248. The domed lid 212 may also include one or more support features 250 extending around a perimeter of the ring 248. The support features 250 may be coupled with the underside surface 244 and the ring 248 and configured to structurally support or stabilize the ring 248 relative to the underside surface 244.

In a closed configuration, the ring 248 and/or the tongue 249 may extend into the neck 240 at the opening 241. In some cases, the ring 248 and/or the tongue 249 may contact, engage, or otherwise overlap with a surface of the neck 240. For example, the ring 248 and/or the tongue 249 may contact or engage a surface of the neck 240 to form an interference fit between the domed lid 212 and the container body 208. This may help maintain the domed lid 212 in a closed configuration. As shown in FIG. 3C, to facilitate the foregoing, the tongue 249 may have a thickness that is greater than a thickness of the ring 248. In other embodiments, the ring 248 and/or the tongue 249 may extend into the opening without substantially contacting a surface of the neck 240.

Figure 4:
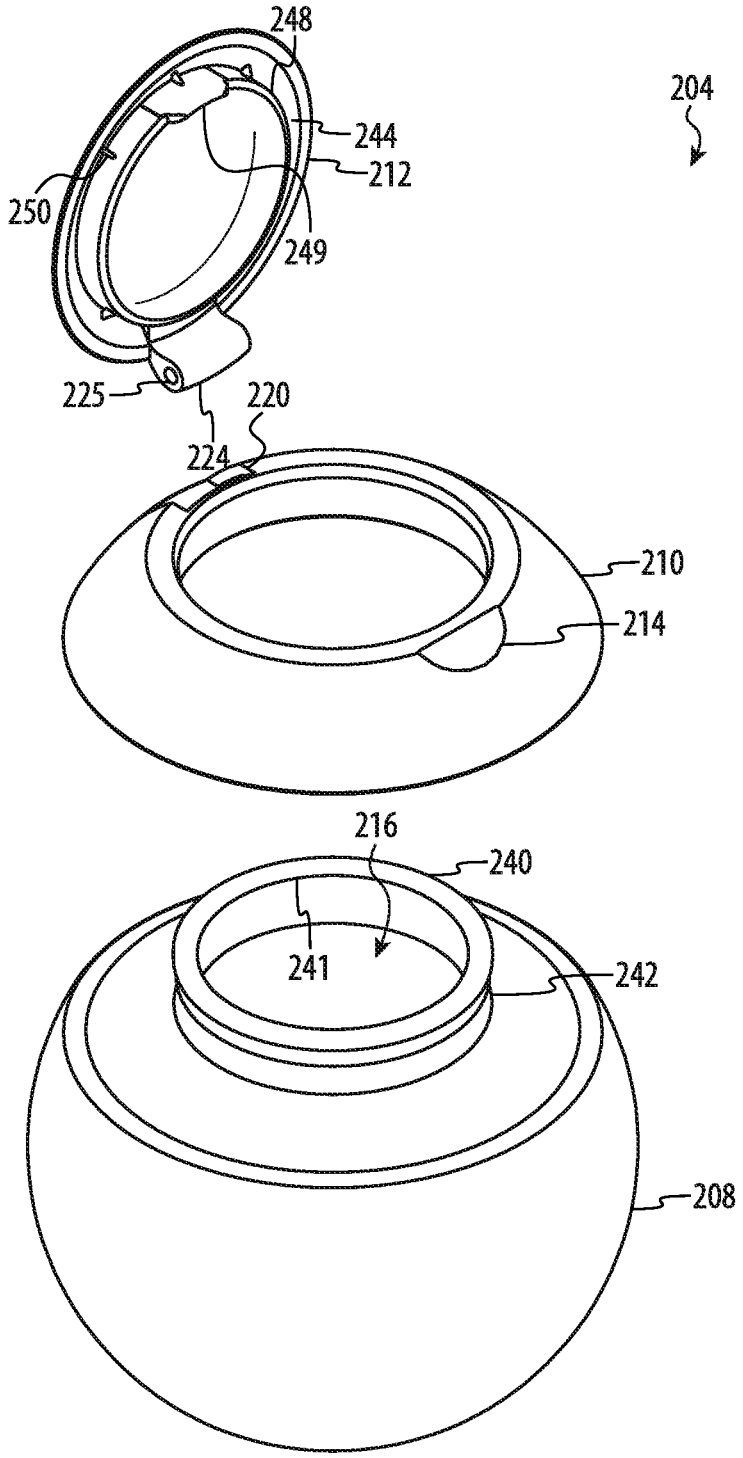
FIG. 4 depicts an exploded view of the spherical bottle of FIG. 3A.

FIG. 4 depicts an illustrative exploded view of the embodiment of the spherical bottle 204 shown in FIG. 3C. As described above, the spherical bottle 204 may include the container body 208, the collar 210, and the domed lid 212. The domed lid 212 may be configured to pivot relative to the container body 208 and/or the collar 210 to selectively enclose or cover the internal volume 216 of the container body 208.

To facilitate the foregoing, and as described above with respect to FIGS. 3A and 3B, the domed lid 212 and the collar 210 may be pivotally coupled by the first and second hinge members 220, 224. The first and second hinge members 220, 224 may be coupled in a variety of manners such that the first and second hinge members 220, 224 pivot relative to one another. As one possibility, the first hinge member 220 may provide support for a pin or other retention member (e.g., pin 225, described in greater detail below) that extends across the notched or receiving portion defined by the first hinge member 220. The second hinge member 224 may be configured to rotate or pivot within the first hinge member 220. For example, the second hinge member 224 may include a hole that is configured to receive a pin 225 that is supported within the first hinge member 220. The second hinge member 224 may rotate about such pin and thus pivot relative to the collar 210.

The collar 210 may be coupled to the container body 208. In one embodiment, the collar 210 may be affixed, attached or substantially immoveable relative to the container body 208. As described above, the collar 210 may be positioned around the neck 240 of the container body 208. In this regard, the collar 210 may be secured, attached, or affixed to the container body 208 at the neck 240. The neck 240 may include one or more components or features to secure or affix the collar 210 and the container body 208. As shown in FIG. 4, an exterior surface of the neck 240 may define a threaded feature 242. The collar 210 may be positioned around the neck 240 and configured to engage with the threaded feature 242. For example, the collar 210 may include one or more components or features that receive, engage, or interlock with the threaded feature 242. The interlocking of or engagement between the threaded feature 242 and the collar 210 may affix or otherwise restrict movement of the collar 210 relative to the container body 208. In one example, the collar 210 includes a protrusion or feature that is configured to engage the threaded feature 242 formed around the neck 240. In another example, the collar 210 includes a mating thread that is configured to engage the threaded feature 242 formed around the neck 240 by twisting the collar 210 with respect to the neck 240. In other cases, the collar 210 may be connected to the container body 208 at the neck 240 in a manner that allows the collar 210 to slide or move relative to the container body 208.

Figure 5A:
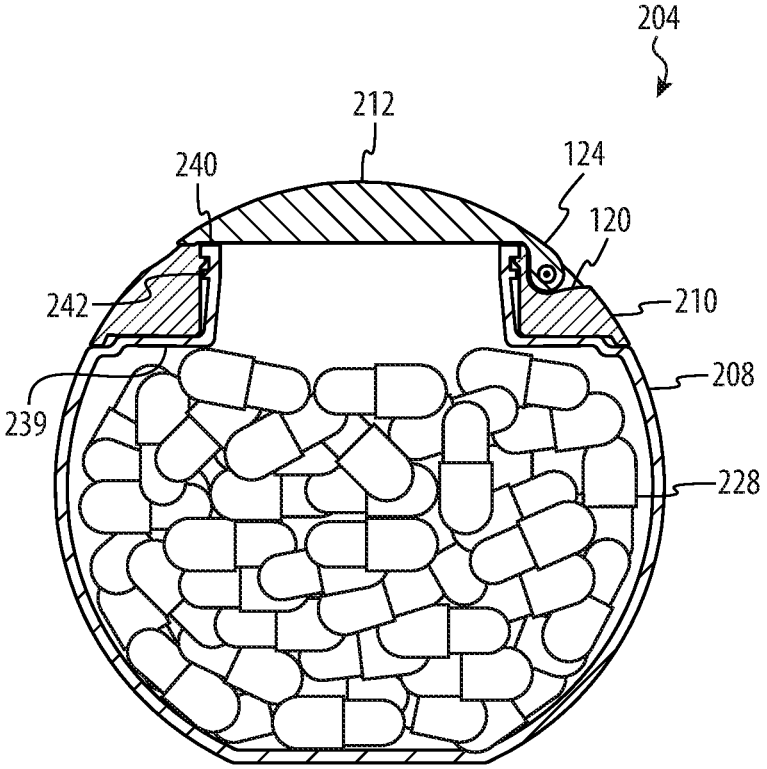
FIG. 5A depicts a cross-sectional view of the embodiment of the spherical bottle of FIG. 3A, taken along line B-B of FIG. 3A.
Figure 5B:
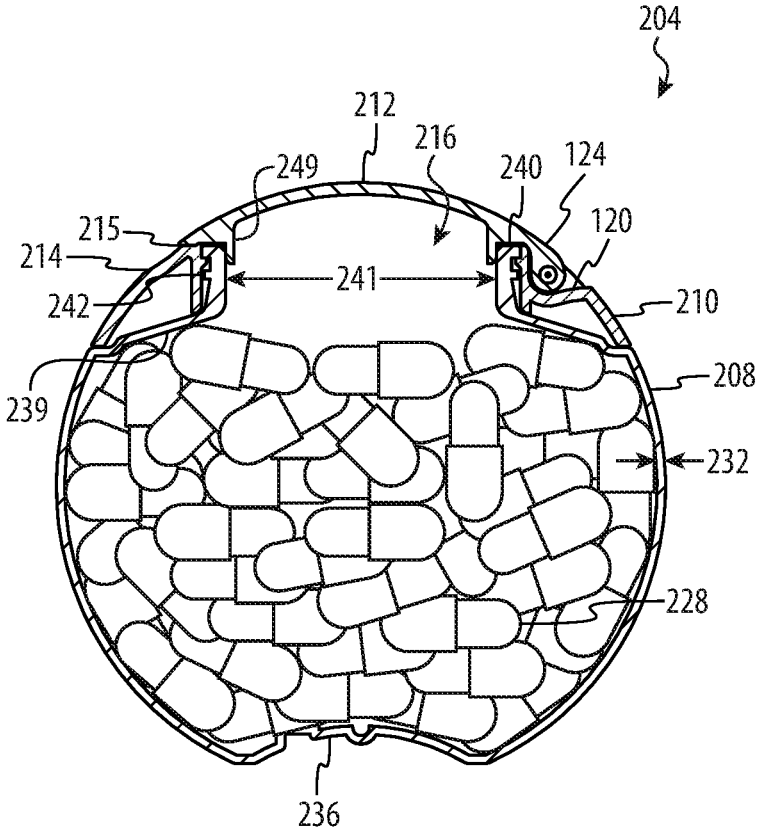
FIG. 5B depicts a cross-sectional view of another embodiment of the spherical bottle of FIG. 3A, taken along line B-B of FIG. 3A.

FIGS. 5A and 5B depict cross-sectional views of embodiments of the spherical bottle 204 of FIG. 3A, taken along line B-B of FIG. 3A. In the embodiments of FIGS. 5A and 5B, the spherical bottle 204 is shown in a closed configuration and containing ingestible pills 228.

With reference to FIG. 5A, a simplified cross-sectional view of the spherical bottle 204 of FIG. 3A is shown. In the embodiment of FIG. 5A, the spherical bottle 204 is shown having the container body 208, the collar 210, and the domed lid 212. A group of ingestible pills 228 may be positioned within an internal volume 216 defined by the container body 208.

The container body 208 is shown as defining a shoulder 239 and the neck 240. The shoulder 239 may define a top surface of the container body 208. For example, the shoulder 239 may be a portion of the container body that extends inward from an exterior spherical or convex surface. The shoulder 239 may be used to support or position the collar 210 above the internal volume 216.

The neck 240 may extend from the shoulder 239 and define the opening 241. For example, the neck 240 may be attached or integrally formed with the shoulder 239 and positioned above the internal volume 216. As such, the shoulder 239 and the opening 241 may cooperate to define a width of the opening 241 that is less than a maximum width of the internal volume 116, such as a width of the internal volume 116 at a middle of the spherical bottle 204. The opening 241 may thus be restricted, which may allow for controlled dispensing of the ingestible pills 228 in a measured or predictable manner.

With reference to FIG. 5B, a detailed cross-sectional view of the spherical bottle 204 is shown. As shown in FIG. 5B, the spherical bottle 204 may resemble a shape of a sphere (e.g., a substantially spherical surface) when in the closed configuration. As described above, the container body 208, the collar 210, and the domed lid 212 may cooperate to define the substantially spherical shape of the spherical bottle 204. The domed lid 212 may be configured to pivot into an open configuration but also maintain the substantially spherical shape of the spherical bottle 204 in the closed position. For example, the first hinge member 120 may define a recess or notch that extends inward toward a center of the spherical bottle 204. The second hinge member 124 may be a protrusion that extends along a convex surface of the domed lid 212 and into the recess defined by the first hinge member 220. As such, the first and second hinge members 220, 224 may not substantially extend outside of the spherical surface of the spherical bottle 204.

The container body 208 may also include a base 236. The base 236 may be substantially analogous to the base 136 described with respect to FIG. 2. For example, the base 236 may be configured to maintain the container body 208 in an upright or semi-upright position. In the embodiment of FIG. 5B, the base 236 may be defined by a concave bottom surface of the container body 208. In some cases, the base 236 may include various grooves, recesses, notches or the like which may facilitate manufacturing the container body 208 as a single or integral component.

Figure 6:
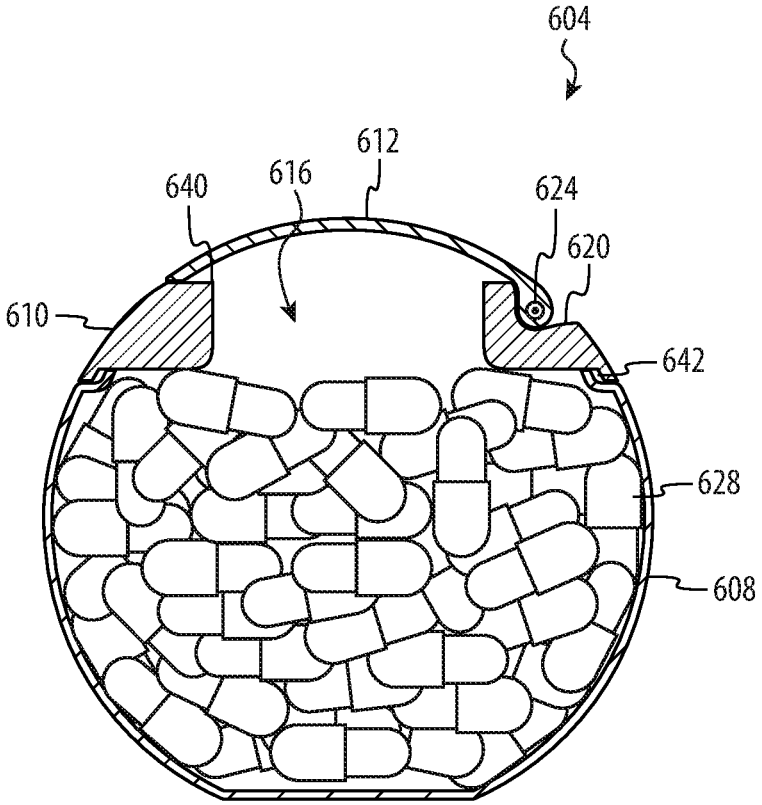
FIG. 6 depicts a cross-sectional view of a spherical bottle according to another embodiment.
Figure 7:
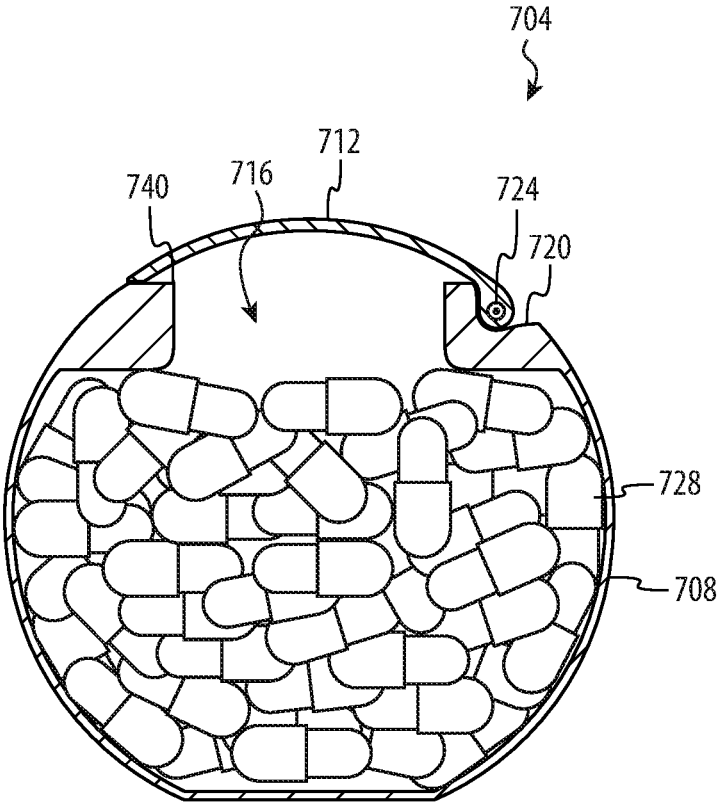
FIG. 7 depicts a cross-sectional view of a spherical bottle according to another embodiment.
Figure 8:
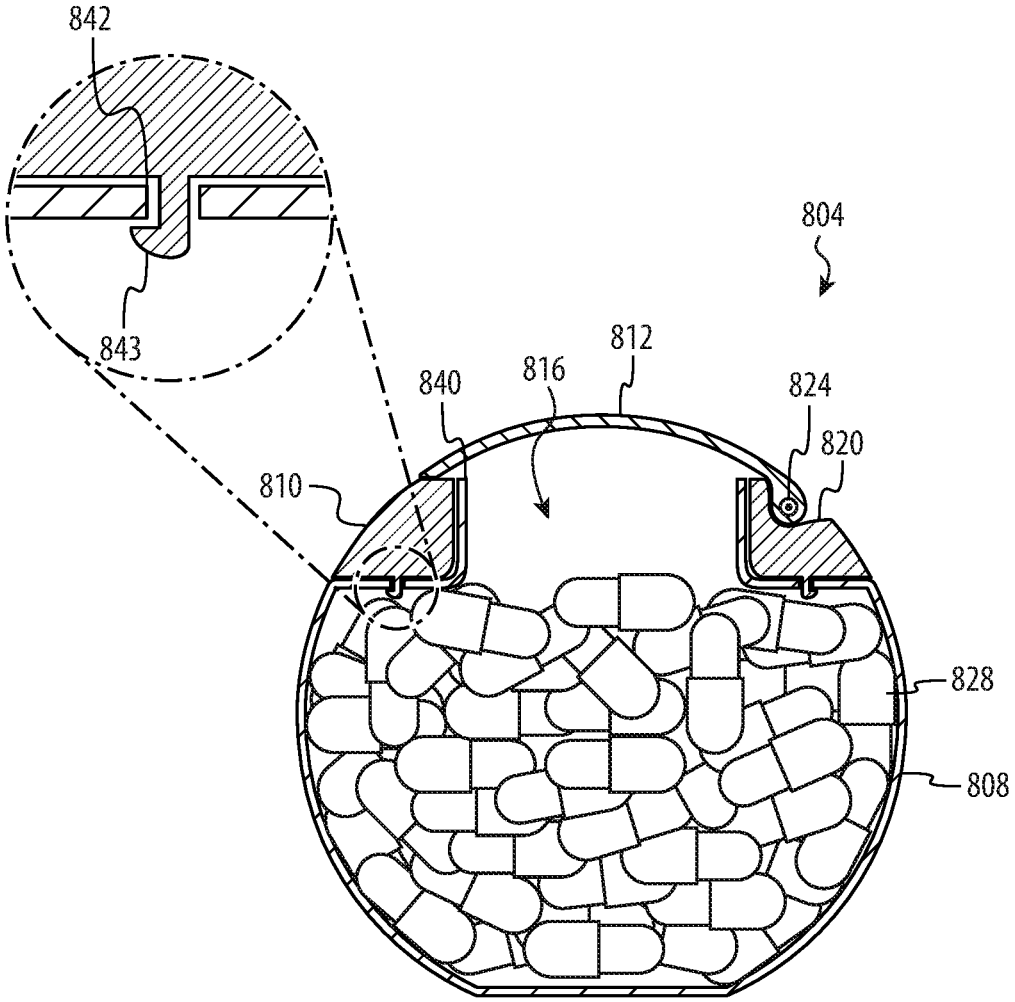
FIG. 8 depicts a cross-sectional view of a spherical bottle according to another embodiment.

FIGS. 6-8 depict cross-sectional views of alternate embodiments of a spherical bottle, according to the embodiments described herein. For example, one or more components or features of the spherical bottle (e.g., a domed lid, a collar, a container body, and so forth) may define a neck that is configured for controlled dispensing of ingestible pills when the spherical container is tipped or otherwise manipulated. The spherical bottle may also use various engagement features to facilitate a connection between the container body, the collar, and/or the domed lid, as described herein. It will be appreciated, however, that the embodiments of FIGS. 6-8 are shown for purposes of illustration, and that other configurations of necks, engagement features, and/or other structures or assemblies are contemplated within the scope of the present disclosure.

With reference to FIG. 6, a spherical bottle 604 is described. The spherical bottle 604 may be substantially analogous to the spherical bottle 204 described above with respect to FIGS. 2-5B. For example, the spherical bottle 604 may be a substantially spherically shaped pill bottle configured to hold and selectively dispense ingestible pills 628. In this regard, the spherical bottle 604 may include a container body 608, a collar 610, a domed lid 612, an internal volume 616, a first hinge member 620, a second hinge member 624, a neck 640, and an engagement feature 642.

In the embodiment of FIG. 6, the collar 610 may define an opening 640. For example, the collar 610 may have an outer surface that defines a portion of the substantially spherical outer surface of the spherical bottle 604. The collar 610 defines an opening 640 that extends into the internal volume 616, from the substantially spherical outer surface. The collar 610 may therefore be used to define a reduced or restricted passage into the internal volume 616 through which a user may dispense the ingestible pills 628 in a controlled or predictable manner.

The collar 610 may be coupled to the container body by the engagement feature 642. The engagement feature 642 may be a threaded feature, snap-fit, and/or other structure or mechanism, that facilitates a connection between the collar 610 and the container body 608. In some cases, the collar 610 may be removed from the container body 608 without breaking or damaging the spherical bottle 604.

With reference to FIG. 7, a spherical bottle 704 is described. The spherical bottle 704 may be substantially analogous to the spherical bottle 204 described above with respect to FIGS. 2-5B. For example, the spherical bottle 704 may be a substantially spherically shaped pill bottle configured to hold and selectively dispense ingestible pills 728. In this regard, the spherical bottle 704 may include a container body 708, a domed lid 712, an internal volume 716, a first hinge member 720, a second hinge member 724, and a neck 740.

In the embodiment of FIG. 7, the container body 708 defines the neck 240 and the second hinge member 720. For example, the container body 708 may have a wall at a top portion of the spherical bottle 704 that has an increased thickness. The portion of the wall having the increased wall thickness may define a reduced or restricted passage into the internal volume 716, through which a user may dispense the ingestible pills 728 in a controlled or predictable manner.

At or near the portion of the wall having the increased wall thickness, the container body 708 may define the second hinge member 724. The second hinge member 724 may be a groove, recess, receiving portion, and so forth that is used to engage the first hinge member 720 and pivotally couple the container body 708 to the domed lid 712. Accordingly, the container body 708 may both be used to engage a pivoting member of the domed lid 712 and define a neck or other passage for controlled dispensing of the ingestible pills 728.

With reference to FIG. 8, a spherical bottle 804 is described. The spherical bottle 804 may be substantially analogous to the spherical bottle 204 described above with respect to FIGS. 2-5B. For example, the spherical bottle 804 may be a substantially spherically shaped pill bottle configured to hold and selectively dispense ingestible pills 828. In this regard, the spherical bottle 804 may include a container body 808, a collar 810, a domed lid 812, an internal volume 816, a first hinge member 820, a second hinge member 824, a neck 840, a first engagement feature 842, and a second engagement feature 843.

In the embodiment of FIG. 8, the collar 810 may be coupled to the container body 808 using snap-fit engagement features. As shown in FIG. 8, the container body 808 may define a first engagement feature 842 and the collar 810 may define a second engagement feature 843. The first engagement feature 842 may be an opening, groove, slot, or other feature extending partially or fully through a wall of the container body 808. The second engagement feature 843 may be a protrusion extending from a bottom surface of the collar 810 and having a lip or catch portion at a free end.

The first engagement feature 842 may receive the second engagement feature 843 and secure the collar 810 to the container body 808. For example, the second engagement feature 843 may be at least partially deformable and have a contoured surface in order to allow the lip or catch portion to slide through the first engagement feature 842. Once inserted, the first engagement feature 842 may restrict movement of the second engagement member from 843. For example, the lip or catch portion may have a planar surface or other contoured surface that substantially prevents the second engagement member from sliding out of the first engagement member.

Other examples and implementations are within the scope and spirit of the disclosure and appended claims. For example, features implementing functions may also be physically located at various positions, including being distributed such that portions of functions are implemented at different physical locations. Also, as used herein, including in the claims, "or" as used in a list of items prefaced by "at least one of" indicates a disjunctive list such that, for example, a list of "at least one of A, B, or C" means A or B or C or AB or AC or BC or ABC (i.e., A and B and C). Further, the term "exemplary" does not mean that the described example is preferred or better than other examples.

The foregoing description, for purposes of explanation, uses specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. A spherical bottle, comprising:

a container body having an internal volume for holding ingestible pills and comprising:

a shoulder defining an upper surface of the container body;

a neck extending from the shoulder and defining an opening into the internal volume; and a concave bottom surface defining an edge that supports the spherical bottle when the spherical bottle is placed in an upright position;

a collar connected to the container body and positioned around the neck; and a domed lid configured to pivot relative to the container body and cover the opening of the neck when closed and expose the opening of the neck when open, wherein the container body, collar, and domed lid each define a respective portion of a substantially spherical outer surface of the spherical bottle.

2. The spherical bottle of claim 1, wherein:

the collar includes a notch that defines a first hinge member;

the domed lid includes a protrusion that defines a second hinge member that is positioned within the notch of the first hinge member; and the first hinge member and the second hinge member cooperate to pivotally couple the domed lid and the collar.

3. The spherical bottle of claim 2, wherein:

when the domed lid is closed, the first hinge member and the second hinge member cooperate to define a partially spherical surface.

4. The spherical bottle of claim 1, wherein the opening has a width that is less than half of a width of a middle portion of the container body.

5. The spherical bottle of claim 4, wherein the width of the middle portion is between one and five inches.

6. The spherical bottle of claim 1, wherein the domed lid is pivotally coupled to the container body at the shoulder.

7. A spherical bottle, comprising:

a container body defining an internal volume configured to hold a group of pills, a neck having an opening extending into the internal volume, and a first partially spherical surface of the spherical bottle;

a collar attached to the container body, surrounding the neck, and defining a second partially spherical surface of the spherical bottle, the collar including a notched portion; and a domed lid pivotally coupled to the collar configured to seal the internal volume at the neck, and defining a third partially spherical surface of the spherical bottle, wherein:

the first partially spherical surface, the second partially spherical surface, and the third partially spherical surface define a substantially spherical outer surface of the spherical bottle;

the notched portion forms an undercut with the doomed lid; and the undercut is configured to receive a force that pivots the domed lid relative to the collar.

8. The spherical bottle of claim 7, wherein:

the domed lid includes a lip that extends from a bottom surface; and the lip is configured to engage the neck when the domed lid is closed.

9. The spherical bottle of claim 8, wherein the lip maintains contact with a surface of the neck when the domed lid is closed.

10. The spherical bottle of claim 7, wherein:

the neck includes a threaded feature; and the container body and the collar are attached by the threaded feature.

11. The spherical bottle of claim 7, wherein:

the neck includes a snap-fit feature; and the container body and the collar are attached by the snap-fit feature.

12. The spherical bottle of claim 7, wherein the opening has a width configured to channel the group of pills from the internal volume when the spherical bottle is tilted.

13. The spherical bottle of claim 7, wherein the container body has a bottom region having a width configured to prevent tipping of the spherical bottle when the spherical bottle is in an upright position.

14. A spherical bottle, comprising:

a container body defining an internal volume and a first partially spherical outer surface extending from a bottom portion of the spherical bottle to beyond a centerline of the spherical bottle, the bottom portion of the spherical bottle including a concave bottom surface defining an edge that supports the spherical bottle when the spherical bottle is placed in an upright position;

a collar coupled to the container body and defining a second partially spherical outer surface; and a domed lid extending over an opening of the collar and defining a third partially spherical outer surface, the domed lid coupled to at least one of the collar or the container body via a hinge mechanism and configured to pivot relative to the container body to contain ingestible pills within the internal volume when the domed lid is in a closed configuration, wherein the first partially spherical outer surface cooperates with the second partially spherical outer surface and the third partially spherical outer surface to define a substantially spherical outer surface of the spherical bottle.

15. The spherical bottle of claim 14, wherein the domed lid is positioned concentric with a central axis of the container body.

16. The spherical bottle of claim 14, wherein the first partially spherical outer surface of the container body is a substantially seamless surface.

17. The spherical bottle of claim 14, wherein the collar is coupled to the container body via a snap-fit engagement feature.

18. The spherical bottle of claim 14, wherein the collar is coupled to the container via a snap-fit engagement feature.

* * * * *